US011982092B2

(12) United States Patent
Gil

(10) Patent No.: US 11,982,092 B2
(45) Date of Patent: May 14, 2024

(54) DECOUPLING SHEET

(71) Applicant: NIETOS DE MIGUEL MARTINEZ RAMIREZ, S.L., Alicante (ES)

(72) Inventor: Ramon Martinez Gil, Alicante (ES)

(73) Assignee: NIETOS DE MIGUEL MARTINEZ RAMIREZ, S.L., Alicante (ES)

( * ) Notice: Subject to any disclaimer, the term of this patent is extended or adjusted under 35 U.S.C. 154(b) by 954 days.

(21) Appl. No.: 16/967,325

(22) PCT Filed: Feb. 5, 2019

(86) PCT No.: PCT/ES2019/070059
§ 371 (c)(1),
(2) Date: Aug. 4, 2020

(87) PCT Pub. No.: WO2019/155104
PCT Pub. Date: Aug. 15, 2019

(65) Prior Publication Data

US 2020/0362573 A1 Nov. 19, 2020

(30) Foreign Application Priority Data

Feb. 7, 2018 (ES) ..... P 201830104

(51) Int. Cl.
*E04F 15/18* (2006.01)

(52) U.S. Cl.
CPC ..... *E04F 15/18* (2013.01)

(58) Field of Classification Search
None
See application file for complete search history.

(56) References Cited

U.S. PATENT DOCUMENTS 4,037,013 A * 7/1977 Sprague ..... B32B 27/14 428/903.3
2006/0032170 A1* 2/2006 Vershum ..... E04F 15/186 52/746.1
2016/0032597 A1* 2/2016 Keane ..... E04F 15/10 52/741.1

FOREIGN PATENT DOCUMENTS

ES 2308281 T3 12/2008
ES 2317110 T3 4/2009
ES 1078101 U 11/2012
ES 2609306 A1 4/2017
GB 2309714 A 8/1997
JP 2014224390 A * 12/2014

OTHER PUBLICATIONS

Machine translation of JP 2014224390 A via EPO (translated Aug. 2, 2023 (Year: 2014).*
Apr. 4, 2019 (WO) International Search Report—App. PCT/ES2019/070059.

* cited by examiner

*Primary Examiner* — Elizabeth Collister
(74) *Attorney, Agent, or Firm* — Darrell G. Mottley

(57) ABSTRACT

The invention relates to a decoupling sheet that can be disposed between a floor covering and the floor and comprises a multi-layer structure that includes a central core and respective outer layers attached to larger surfaces of the central core, the central core being made of elastic foam material.

9 Claims, 1 Drawing Sheet

DECOUPLING SHEET

The present application is a U.S. National Phase Application under 35 U.S.C. § 371 of PCT/ES2019/070059 filed Feb. 5, 2019 which claims priority to ES P201830104, filed Feb. 7, 2018, the contents therein of the applications is incorporated by reference herein in its entirety.

TECHNICAL FIELD OF THE INVENTION

The present invention is encompassed within the field of materials used in the construction industry.

Said invention is a decoupling sheet, which can be disposed between the floor covering and the floor, with a view to avoiding the formation of cracks in the finish of the floor covering due to variations undergone by the floor, which are transmitted to the floor covering.

BACKGROUND OF THE INVENTION

In construction, it is very common to have a floor covering on a floor, for example, pieces of ceramic on concrete, forming an integral body that behaves as if it were a single piece. For this reason, the variations that the floor undergoes, whether expansion or contraction, for example, due to changes in temperature or settlement of the building, are transmitted to the floor covering, causing cracks to appear in the finish of the latter, presenting problems, in addition to undermining the aesthetics of the finish.

Laminar elements are known that are disposed between the floor and the floor covering. Said laminar elements are composed of plastic layers, which absorb by deformation the aforementioned variations suffered by the floor.

On the other hand, waterproofing sheets are also known, which, likewise, are disposed between the floor covering and the floor, with the obvious purpose of avoiding the filtration of water, water vapour, etc. These sheets are commonly used in places where there are risks of damp, either indoors or outdoors.

Likewise, there are known laminar elements aimed at solving both problems, that is, they absorb the variations suffered by the floor while at the same time limiting the passage of water, water vapour, etc. through its structure. For example, the decoupling sheet disclosed in patent document ES2609306, which comprises a multi-layer structure made up of a central core and two waterproof outer layers, where the outer layers are attached to two larger surfaces of the central core, and the latter is made of a non-woven textile or woven fibres. Thus, with the inclusion of the central core of non-woven textile or woven fibres between the waterproof outer layers, the assembly consisting of the floor and the floor covering can be decoupled, as well as limiting the passage of water, water vapour, etc. from one element to another of said assembly.

However, due to the passage of time, and depending on the magnitude of the variations to which the floor has been exposed, the non-woven textile core eventually breaks, and with this, the floor covering becomes separated from the floor, as if it were of a floating layer on said floor, leaving the floor covering structure unsupported, which may cause it to break.

For this reason, there is a need to design a decoupling sheet whose structure allows solving the aforementioned problem.

DESCRIPTION OF THE INVENTION

The present invention is defined and characterised by the independent claims, while the dependent claims describe additional features thereof.

The object of the invention is a decoupling sheet, which is suitable for being disposed between a floor covering and a floor. The main technical problem to be solved is to provide an alternative solution that avoids the transmission of the variations undergone by the floor to the floor covering, maintaining the integrity of the attachment between the two elements, that is, without the floor covering becoming separated from the floor and forming a floating layer that leads to its breakage.

The sheet comprises a multi-layer structure that includes a central core and respective outer layers attached to larger surfaces of the central core, wherein said central core is made of an elastic foam material.

The decoupling sheet is disposed between the floor and the floor covering in such a way that, when the floor undergoes variations due to expansion or contraction of its material, the elastic foam material that makes up the central core absorbs said variations recognised as floor movements, thereby avoiding transmission to the floor covering of the movements suffered by the floor, this implying that no cracks will appear in the finish of the latter.

The elastic foam material can be selected from the group consisting of latex, rubber, and elastic polymer; and preferably, it comprises an open cell structure.

The open cell structure is characterised by its elasticity and firmness. Thanks to the fact that an air content can move through the cells that make it up, it is possible to create a space that absorbs the different movements that may originate between its cell layers, which facilitates the decoupling without affecting its physical integrity. It thus constitutes a hard but at the same time flexible support, which manages to absorb the stresses between the floor covering and the floor without breaking the attachment between the two elements. In other words, it enables the cladding support to be decoupled, neutralising the stresses transmitted to its attachment to the floor, without entailing its detachment from the latter.

Moreover, the elastic foam material used to form the central core of the decoupling sheet may comprise a closed cell structure. In this case, the central core manages to perform the same function but with less efficiency.

BRIEF DESCRIPTION OF THE DRAWINGS

The present specification is completed by a set of figures that illustrate a preferred embodiment that in no way limits the invention.

DETAILED DESCRIPTION OF THE INVENTION

The present invention is a decoupling sheet, which is disposed between a floor covering and a floor, with a view to avoiding the formation of cracks in the floor covering finish due to variations undergone by the floor, for example, movements due to of the expansion or contraction of the material of the latter.

The decoupling sheet can be marketed in rolls, coils, etc.

Figure 1:
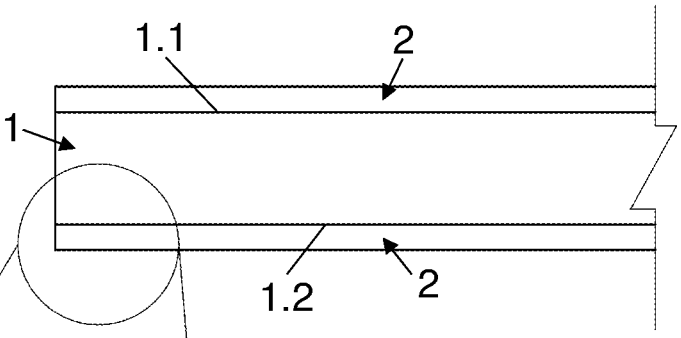
FIG. 1 represents a front view of the decoupling sheet.

As shown in FIG. 1, the sheet comprises a multi-layer structure which in turn comprises:

a central core (1), and two outer layers (2).

Each outer layer (2) is attached to one of the larger surfaces (1.1, 1.2) of the central core (1), said central core (1) being made of an elastic foam material.

Preferably, the elastic foam material that forms the central core (1) is selected from the group consisting of latex, rubber, and elastic polymer; and can comprise an open or closed cell structure. More preferably, it comprises an open cell structure.

For example, in a preferred embodiment of the decoupling sheet, its central core (1) is formed from open-cell latex foam.

Thus, the elastic foam material that makes up the central core (1) allows the attachment between the floor and the floor covering (not illustrated in the figures) to be decoupled, without the latter detaching or separating from the former. The elastic foam material effectively absorbs the movement experienced by the floor, so as not to affect the finish of the floor covering. That is, while one of the outer layers (2) of the sheet moves with the floor, the other layer (2) remains unchanged next to the floor covering, thus absorbing, through the momentary deformation of the material of the central core (1), the variations of the floor without releasing the attachment between the outer layers (2) of the sheet.

Figure 2:
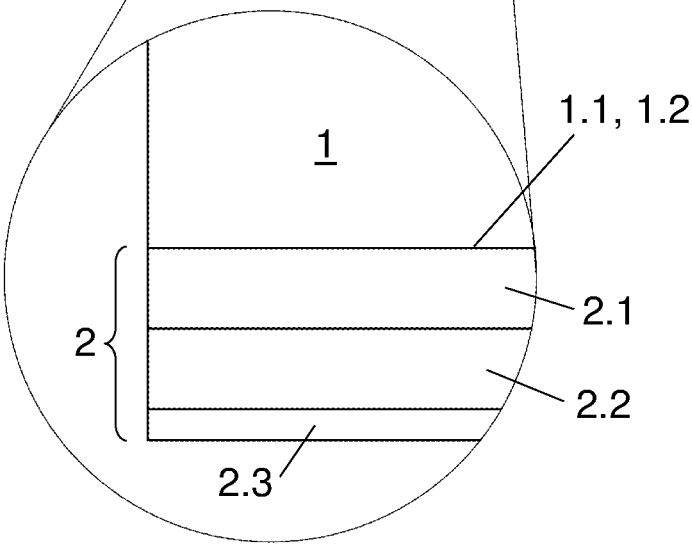
FIG. 2 represents an enlarged detail of FIG. 1, showing the composition of the outer layer of the decoupling sheet.

As can be seen in FIG. 2, it is preferred that at least one of the outer layers (2) comprises at least one sub-layer of waterproofing material (2.1), for example, polyolefin.

This preferred composition of the outer layer (2) with at least one layer of waterproofing material (2.1) provides one or more barriers to the passage of water and moisture, depending on the number of sub-layers (2.1) included.

Likewise, it is preferred that at least one of the outer layers (2) comprises an outer sub-layer (2.3) of geotextile material, which facilitates a better grip with the adhesive (not illustrated in the figures) that attaches it to the floor covering, while also favouring the dispersion of water vapour being generated.

Additionally, at least one of the outer layers (2) can comprise at least one sub-layer of reinforcing mesh (2.2), in the case of expansion joints.

The invention claimed is:

1. A decoupling sheet, which can be disposed between a floor covering and a floor, comprising a multi-layer structure that includes a central core and respective outer layers attached to larger surfaces of the central core, so that one of the outer layers (2) is facing to the floor covering and the other outer layer is facing to the floor, wherein the central core is made of an elastic foam material, and the outer layer facing to the floor comprises an outer sub-layer of geotextile material, in that the outer layer facing to the floor also comprises at least one sub-layer of waterproofing material and at least one sub-layer of reinforcing mesh arranged between the corresponding larger surface of the central core and the outer sub-layer of the outer layer facing to the floor.

2. The decoupling sheet according to claim 1, wherein the elastic foam material is selected from the group consisting of latex, rubber, and elastic polymer.

3. The decoupling sheet according to claim 1, wherein the elastic foam material comprises an open cell structure.

4. The decoupling sheet according to claim 1, wherein the elastic foam material comprises a closed cell structure.

5. The decoupling sheet according to claim 1, wherein the outer layer facing to the floor covering further comprises at least one sub-layer of waterproofing material.

6. The decoupling sheet according to claim 5, wherein the sub-layer of waterproofing material is polyolefin.

7. The decoupling sheet according to claim 1, wherein the outer layer (2) facing to the floor covering further comprises at least one sub-layer of reinforcing mesh (2.2).

8. The decoupling sheet according to claim 1, wherein the sub-layer of waterproofing material is polyolefin.

9. The decoupling sheet according to claim 1, wherein the outer layer facing to the floor covering comprises an outer sub-layer of geotextile material.

* * * * *